US007641330B2

(12) United States Patent
Ozaki et al.

(10) Patent No.: US 7,641,330 B2
(45) Date of Patent: Jan. 5, 2010

(54) LIQUID EJECTING APPARATUS

(75) Inventors: Kazuma Ozaki, Nagano-ken (JP); Toshio Karasawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 233 days.

(21) Appl. No.: 11/285,154

(22) Filed: Nov. 23, 2005

(65) Prior Publication Data

US 2006/0132513 A1 Jun. 22, 2006

(30) Foreign Application Priority Data

Nov. 24, 2004 (JP) ..... P2004-338405

(51) Int. Cl.
*B41J 2/01* (2006.01)

(52) U.S. Cl. ..... 347/104; 347/16; 347/5

(58) Field of Classification Search ..... 347/5, 347/9, 14, 16, 19, 104
See application file for complete search history.

(56) References Cited

U.S. PATENT DOCUMENTS

| | | | | |
|---|---|---|---|---|
| 6,168,269 | B1 | 1/2001 | Rasmussen et al. | |
| 6,796,648 | B2 * | 9/2004 | Ohashi | 347/104 |
| 2002/0070991 | A1 * | 6/2002 | Otsuki | 347/16 |
| 2003/0132978 | A1 | 7/2003 | Hinojosa et al. | |

FOREIGN PATENT DOCUMENTS

| | | | |
|---|---|---|---|
| EP | 0699537 | A2 | 3/1996 |
| EP | 1123809 | A2 | 8/2001 |
| JP | 2002-52771 | A | 2/2002 |
| JP | 2003-326743 | A | 11/2003 |

OTHER PUBLICATIONS

Partial European Search Report issued Feb. 5, 2009.

* cited by examiner

*Primary Examiner*—Lam S Nguyen
(74) *Attorney, Agent, or Firm*—Sughrue Mion, PLLC

(57) ABSTRACT

A liquid ejecting head has a head face on which nozzles adapted to eject liquid toward a first face of a target medium are arranged. The liquid ejecting head is adapted to move in a first direction. A conveyance guide member is adapted to support a second face of the target medium so that a distance between the head face and the first face of the target medium is made to be a prescribed value. The conveyance guide member includes a plurality of ribs arrayed in the first direction at a fixed pitch and extending in a second direction perpendicular to the first direction. A medium conveyer is adapted to convey the target medium in a second direction while causing the second face of the target medium to be abutted against the conveyance guide member. A controller is operable to cause the liquid ejecting head to complete liquid ejection toward a leading end portion of the target medium while the leading end portion is located at a region in which an abutment force generated by the medium conveyer becomes maximum.

1 Claim, 9 Drawing Sheets

LIQUID EJECTING APPARATUS

BACKGROUND OF THE INVENTION

The present invention relates to a liquid ejecting apparatus comprising a liquid ejector for ejecting liquid from a head face of a liquid ejecting head onto a target medium, while reciprocating the liquid ejecting head in a primary scanning direction; a conveyance guide member for supporting in a slide contact manner the target medium from a backside of a target surface such that spacing between the head face of the liquid ejecting head and the target surface of the target medium should have a predetermined spacing; and a medium conveyer for conveying the target medium in a secondary scanning direction at a predetermined conveyance rate, while pressing the target medium against a slide contact face of the conveyance guide member.

In liquid ejecting apparatuses represented by ink jet recording apparatuses for performing recording by ejecting ink from a recording head onto a recording surface of a target medium such as recording paper, a problem arises in association with a phenomenon of so-called cockling which is caused when ink ejected onto the target surface is absorbed into the target medium. The cockling indicates the phenomenon that a portion of the target medium that has absorbed the ink expands and thereby causes corrugating deformation in the target medium. The target medium that suffers corrugating deformation is lifted from the slide contact face of the conveyance guide member, and thereby causes concern for so-called head rubbing that a part of the target surface of the target medium comes in contact with the recording head.

For example, Japanese Patent Publication No. 2003-326743A discloses an ink jet recording apparatus capable of performing so-called marginless recording in which recording is performed while discarding ink to the outside of the target medium so that recording is achieved without a blank space in the four side areas of the target medium. In the case of such marginless recording, the ink is ejected without a blank space over the entire surface of the target medium. This causes more easily the corrugating deformation by cockling.

In order to reduce such concern for head rubbing caused by cockling, Japanese Patent Publication No. 2002-52771A discloses a recording apparatus in which a plurality of ribs are arrayed at equal intervals in the primary scanning direction in accordance with the cockling of corrugating deformation generated at an approximately fixed pitch, while the ribs are arranged at a fixed pitch with a certain regularity in the positional relationship with a conveyance follower roller. A pressing force on a target medium exerted by a medium feeding roller and the ribs for supporting, from the backside of the target medium in a state that the pressing force is exerted, allow the cockling pitch in the target medium to agree approximately with the pitch of the ribs. This stabilizes the cockling pitch, and hence reduces concern that the target medium may swell to the recording head face side owing to the cockling and thereby cause head rubbing.

Nevertheless, in the corrugating deformation in the target medium caused by cockling, the shape of corrugating deformation does not become stable immediately at the moment that the liquid is ejected onto the target medium. The corrugating deformation in the target medium caused by cockling gradually changes starting at a time point that the liquid ejection begins. In a portion where the liquid ejection has completed, the deformation reaches a saturated state after a certain time period has elapsed from the time point of completion of liquid ejection. At that time, the corrugating deformation shape reaches a stable state. The time necessary for the corrugating deformation by cockling to reach the stable state varies depending on the quality of the target medium, the characteristics of the liquid, and the like.

Thus, in the configuration disclosed in Japanese Patent Publication No. 2002-52771A, in some cases depending on the type of the target medium, the characteristics of the liquid, and the like, the target medium is conveyed to a conveyance position where the pressing force on the target medium exerted by the medium feeding roller becomes weak, before the corrugating deformation by cockling becomes saturated so that the corrugating deformation shape becomes stable. This causes instability in the pitch of formed cockling so that the corrugating deformation does not agree with the ribs. Accordingly, concern arises that the target medium may be lifted and thereby cause head rubbing.

SUMMARY OF THE INVENTION

It is therefore an object of the invention to provide a liquid ejecting apparatus capable of reducing concern that the cockling pitch may become unstable so that the target medium may be lifted and thereby cause head rubbing.

In order to achieve the above object, according to the invention, there is provided a liquid ejecting apparatus, comprising:

a liquid ejecting head, having a head face on which nozzles adapted to eject liquid toward a first face of a target medium are arranged, the liquid ejecting head adapted to move in a first direction;

a conveyance guide member, adapted to support a second face of the target medium so that a distance between the head face and the first face of the target medium is made to be a prescribed value, the conveyance guide member including a plurality of ribs arrayed in the first direction at a fixed pitch and extending in a second direction perpendicular to the first direction;

a medium conveyer, adapted to convey the target medium in a second direction while causing the second face of the target medium to be abutted against the conveyance guide member; and a controller, operable to cause the liquid ejecting head to complete liquid ejection toward a leading end portion of the target medium while the leading end portion is located at a first position that an abutment force generated by the medium conveyer becomes maximum.

With this configuration, the cockling in the leading end portion of the target medium can be accomplished in the state that the abutment force generated by the medium conveyer becomes maximum. That is, the corrugating deformation by cockling becomes saturated in this condition so that the corrugating deformation shape becomes stable at the early stage of the medium conveyance. Thus, cockling having a pitch in accordance with the shape and the arrangement pitch of the ribs can reliably be formed in the leading end portion of the target medium.

Then, cockling formed by the subsequent liquid ejection is formed approximately at the same pitch as that of the cockling formed first. That is, cockling of a fixed pitch in accordance with the shape and the pitch of the ribs can stably be formed over the entire surface of the target medium. Thus, it is possible to reduce the concern that the cockling pitch may become unstable so that the target medium may be lifted and thereby cause head rubbing.

The controller may be operable to cause the liquid ejecting head to start the liquid ejection toward the leading end portion of the target medium when the leading end portion is located at the first region.

The first region may oppose to one of the nozzles which situating at an upstream end relative to the second direction.

The conveyance guide member may include a groove adapted to receive liquid which has been ejected toward an outside of the leading end portion of the target medium.

With this configuration, even when the so-called marginless printing is performed, cockling can be accomplished in the leading end portion of the target medium at an early step in the initial stage of liquid ejecting operation.

The conveyance guide member may include holes which are located at a downstream side of the groove relative to the second direction, and adapted to generate an air flow for sucking the target medium toward the conveyance guide member.

In this case, it is possible to reduce more reliably the concern that the target medium may be lifted from the slide contact face of the conveyance guide member.

The nozzles may be arrayed in the second direction so as to form a plurality of nozzle arrays which are arranged in the first direction. The controller causes the liquid ejecting head to perform liquid ejection so as to satisfy an equation of $P=N/(s \cdot D \cdot k)$, where P denotes a conveyance rate of the target medium; N denotes the number of nozzles used among the total number of nozzles in each of the nozzle arrays; s denotes the number of times of the movement of the liquid ejection head in the first direction necessary to complete liquid ejections toward all target areas forming a single array extending in the first direction; D denotes the number of nozzle existing in a unit length; k denotes an interpolation coefficient which is a value of a distance between centers of the adjacent nozzles that is expressed by a multiple of a distance between centers of dots formed on the target medium by the liquid in the secondary scanning direction; k and N/s are set to be integers which are relatively prime, no less than 2 and smaller than N.

The medium conveyer may convey the target medium at a rate of $1/(D \cdot k)$ while the liquid ejection toward the leading end portion is performed.

In this case, since the liquid ejection toward the leading end portion of the target medium is performed in a state that the conveyance rate P for the target medium is set at the minimum, the liquid can be ejected intensively onto the leading end portion of the target medium. Thus, cockling of a fixed pitch can be formed in the leading end portion of the target medium at an early stage of liquid ejecting operation.

The controller may cause the medium conveyer to convey the target medium at a first rate while the liquid ejection toward the leading end portion is performed, and at a second rate higher than the first rate after the liquid ejection toward the leading end portion is completed.

In this case, the liquid can be ejected intensively onto the leading end portion of the target medium. Thus, cockling of a fixed pitch can be formed in the leading end portion of the target medium at an early stage of liquid ejecting operation.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
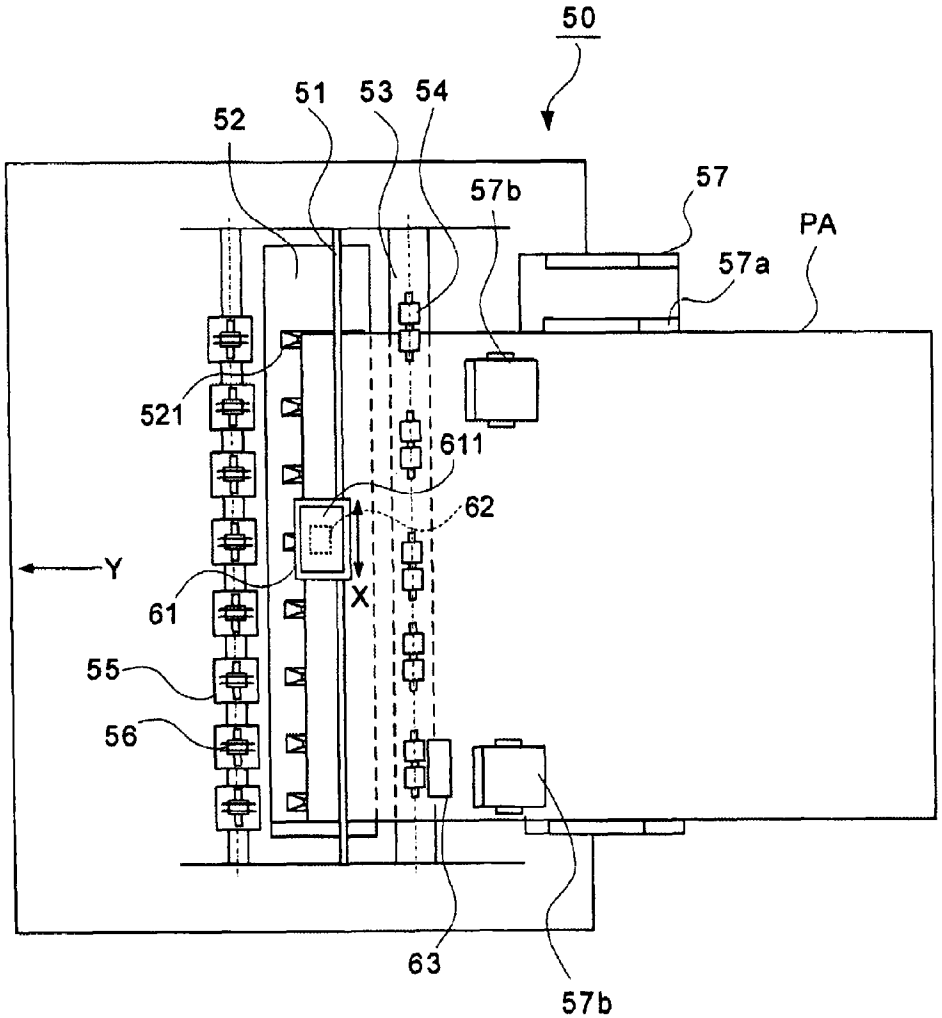
FIG. 1 is a schematic plan view of an ink jet recording apparatus according to one embodiment of the invention.
Figure 2:
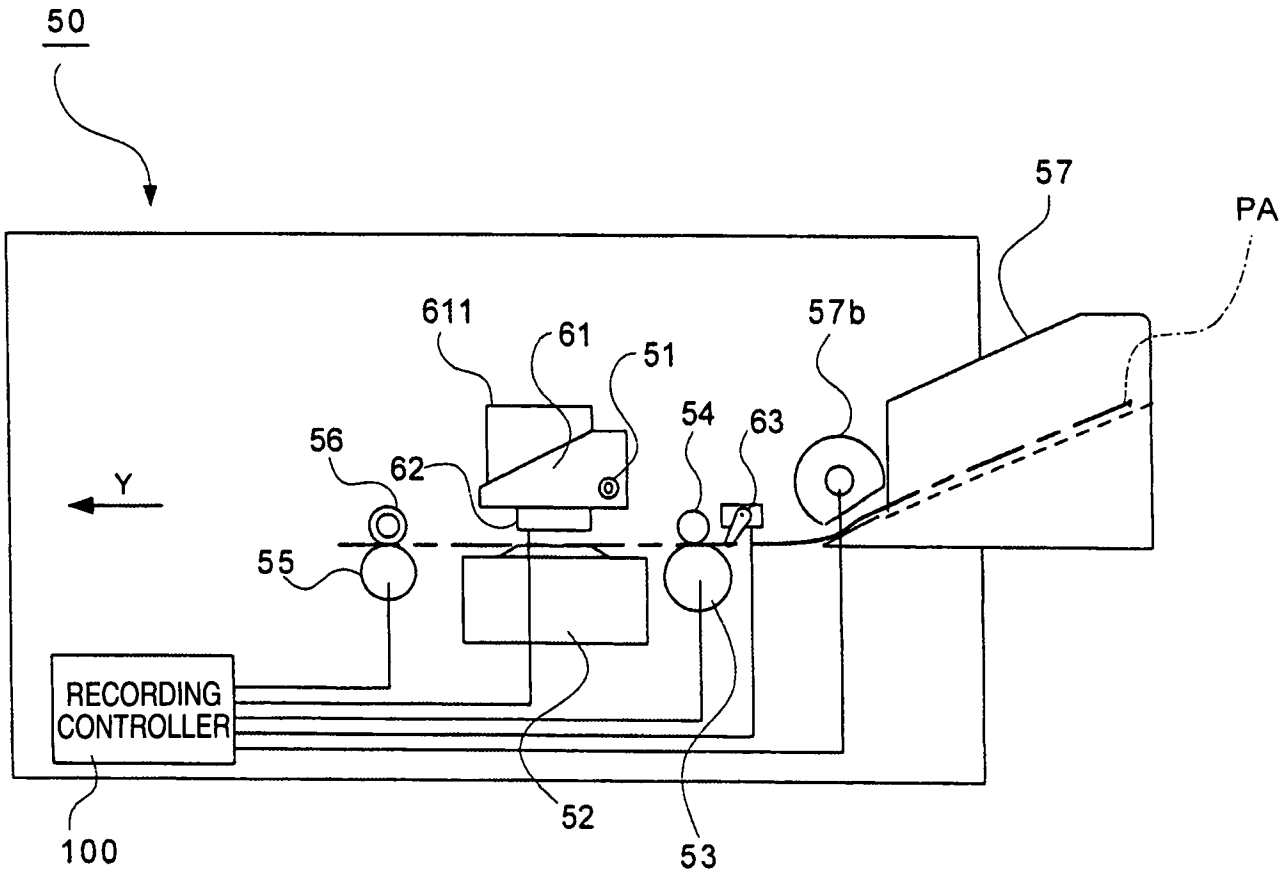
FIG. 2 is a schematic side view of the ink jet recording apparatus.

FIGS. 1 and 2 show an ink jet recording apparatus 50 serving as a liquid ejecting apparatus according to one embodiment of the invention.

In the ink jet recording apparatus 50, a carriage 61 supported on a carriage guide shaft 51 and thereby moving in a primary scanning direction X is provided as a liquid ejector for ejecting ink (liquid) from a head face of a recording head 62 (liquid ejecting head) onto a recording sheet (target medium) PA while reciprocating the recording head 62 in the primary scanning direction X. The carriage 61 carries thereon: the recording head 62; and an ink cartridge 611 filled with ink of each color to be ejected from the recording head 62. At a position opposing the head face of the recording head 62, a platen 52 is provided for setting forth a gap between the head face of the recording head 62 and the recording sheet PA. In the platen 52, a plurality of ribs 521 are formed as shown in the figure.

Further, a conveyance driving roller 53 and a conveyance follower roller 54 are provided as a medium conveyer for conveying a recording sheet PA in a secondary scanning direction Y at a predetermined conveyance rate while pressing the recording sheet PA against a slide contact face of the platen 52 serving as a conveyance guide member. The conveyance driving roller 53 is rotated and controlled by a rotational driving force of a stepping motor or the like. The rotation of the conveyance driving roller 53 causes the recording sheet PA to be conveyed in the secondary scanning direction Y. A plurality of conveyance follower rollers 54 are provided and individually biased by the conveyance driving roller 53. The conveyance follower rollers 54 contact with the recording sheet PA, and thereby follow the conveyance thereof so as to rotate when the recording sheet PA is conveyed by the rotation of the conveyance driving roller 53. A coating having high frictional resistance is applied on the surface of the conveyance driving roller 53. The recording sheet PA pressed against the surface of the conveyance driving roller 53 by the conveyance follower rollers 54 sticks to the surface of the conveyance driving roller 53 by virtue of the frictional resistance of the surface, and thereby is conveyed in the secondary scanning direction Y by the rotation of the conveyance driving roller 53.

The operation of conveying the recording sheet PA in the secondary scanning direction Y at a predetermined conveyance rate and the operation of ejecting ink from the recording head 62 onto the recording sheet PA during one round trip of the recording head 62 in the primary scanning direction X are repeated alternately, so that recording is performed on the recording sheet PA.

A sheet feeding tray 57 is arranged on the upstream side of the secondary scanning direction Y of the conveyance driving roller 53. The sheet feeding tray 57 can feed a recording sheet PA such as a regular paper sheet and a photographic paper sheet. In the vicinity of the sheet feeding tray 57, an ASF (automatic sheet feeder) is provided for automatically feeding a recording sheet PA. The ASF is a mechanism that includes: two sheet feeding rollers 57*b* provided in the sheet feeding tray 57; and a separating pad not shown. One of the two sheet feeding rollers 57*b* is arranged on one side of the sheet feeding tray 57, while the other sheet feeding roller 57*b* is attached to a sheet guide 57*a*. The sheet guide 57*a* is provided in the sheet feeding tray 57 in a manner capable of sliding in the primary scanning direction X in accordance with the width of the recording sheet PA. Then, when a plurality of recording sheets PA placed in the sheet feeding tray 57 are to be fed, the rotational driving force of the sheet feeding roller 57*b* and the frictional resistance of the separating pad allow a single recording sheet to be accurately separated individually and then fed automatically, without feeding a plurality of recording sheets PA at once.

Further, between the sheet feeding roller 57*b* and the conveyance driving rollers 53, a sheet detector 63 is arranged. The sheet detector 63 includes a lever provided with self-restoration behavior into a standing position and supported pivotably in a state protruding into a conveying path for the recording sheet PA in a manner capable of rotating only in the recording paper conveyance direction. When the tip of this lever is pushed by the recording sheet PA, the lever rotates so that the recording sheet PA is detected. The leading end and the trailing end of the recording sheet PA having been fed are detected by the sheet detector 63. Then, the recording region is determined on the basis of the detected positions, so that recording is performed.

On the other hand, for ejecting the recording sheet PA after the recording, provided are: an ejection driving roller 55 and an ejection follower roller 56. The ejection driving roller 55 is rotated and controlled by a rotational driving force of a stepping motor or the like. The rotation of the ejection driving roller 55 causes the recording sheet PA after the recording to be ejected in the secondary scanning direction Y. The ejection follower roller 56 is a spur roller having a plurality of sharp teeth in its periphery so that the tip of each tooth goes into point contact with the recording surface (target surface) of the recording sheet PA. A plurality of the ejection follower rollers 56 are individually biased by the ejection driving roller 55. Then, when the recording sheet PA is ejected by the rotation of the ejection driving roller 55, the ejection follower rollers 56 contact with the recording sheet PA, and thereby follow the ejection of the recording sheet PA so as to rotate. Then, a conveyance driving motor (not shown) for driving and rotating the sheet feeding rollers 57*b*, the conveyance driving roller 53, and the ejection driving roller 55 and a carriage driving motor (not shown) for driving the carriage 61 in the primary scanning direction are controlled and driven by a recording controller 100 serving as a liquid ejection controller. Further, the recording head 62 is controlled and driven similarly by the recording controller 100.

Figure 3:
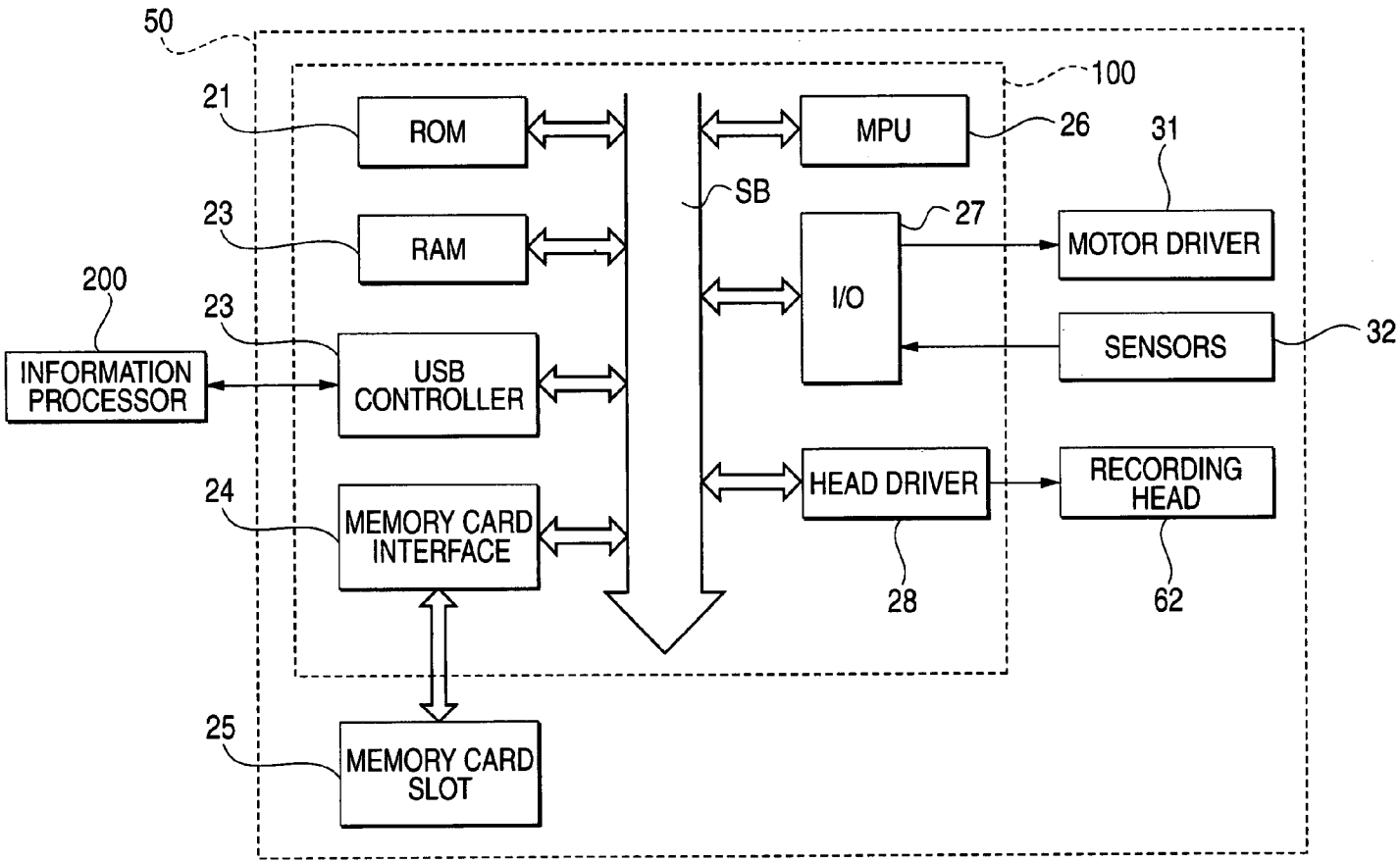
FIG. 3 is a block diagram showing an electric configuration of the ink jet recording apparatus.

As shown in FIG. 3, the recording controller 100 is provided with a system bus SB. The system bus SB is connected, in a manner permitting data transfer, to a ROM 21, a RAM 22, a USB controller 23, a memory card interface 24, an MPU (microprocessor) 26, an I/O 27, and a head driver 28 for driving nozzles N1-NM (see FIG. 7) arranged in the head face of the recording head 62. Arithmetic operations for various processing are performed in the MPU 26. The ROM 21 stores in advance a software program and data necessary for the arithmetic operations in the MPU 26. The RAM 22 is used as a temporary storage area for the software program, a work area for the MPU 26, and the like. Each motor controlling section 31 is a drive control circuit for controlling and driving each motor of the ink jet recording apparatus 50. Each sensor 32 detects various state information of the ink jet recording apparatus 50, and then outputs the data to the I/O 27. The I/O 27 outputs and controls each motor controlling section 31 on the basis of the arithmetic operation results of the MPU 26, and receives input from each sensor 32 and the like.

The USB controller 23 is provided with a dual-role USB interface function. For example, when a USB host unit such as a personal computer is connected as an information processor 200 incorporating a USB host controller, the ink jet recording apparatus 50 is operated as a USB device. In the recording, in the information processor 200, image data is processed by color conversion from RGB data into YMC data, and then processed by binarization so as to be converted into binarized YMC data, so that recording data is generated. The generated recording data is transmitted as recording control data from the information processor 200 to the ink jet recording apparatus 50, together with control data for controlling the ink jet recording apparatus 50. The recording control data transmitted from the information processor 200 is received by the USB controller 23, and then stored into the RAM 22. The recording control data stored in the RAM 22 is processed by command analysis, processing of expanding the compressed recording data, and the like according to the program processing performed in the MPU 26. As a result, the data is separated into control data and recording data. The control data is transferred to the MPU 26, while the expanded recording data is transferred to the head driver 28.

On the other hand, when a USB device such as a digital camera incorporating a USB bus interface is connected, the USB controller 23 causes the ink jet recording apparatus 50 to operate as a USB host unit. Further, the memory card interface 24 reads the image data stored in the memory card inserted into the memory card slot 25. The image data read from the USB device such as a digital camera via the USB controller 23 or the image data read from the memory card via the memory card interface 24 processed by color conversion from RGB data into YMC data, according to the program processing that is performed in the MPU 26. Then, the data is processed by binarization and thereby converted into binarized YMC data, so that recording data is generated. The generated recording data is transferred to the head driver 28 similarly to the case that the recording data is received from the information processor 200. The head driver 28 drives the recording head 62 on the basis of the recording data, so that ink of each color is ejected from the head face of the recording head 62 onto the recording surface of the recording sheet PA. As such, recording is performed on the recording sheet PA.

Next, the platen 52 is described below that serves as a conveyance guide member of the invention with reference to FIGS. 4 to 6.

Ribs 521 serving as ridges are formed in a slide contact face 522 of the platen 52 for supporting the recording sheet PA from the backside of the recording surface in a slide contact manner such that a spacing between the head face of the recording head 62 and the recording surface of the recording sheet PA should have a predetermined dimension. The ribs 521 are formed in parallel to the secondary scanning direction Y as shown in the figure, and are arranged in a plural number in a manner separated from each other in the primary scanning direction X. A plurality of suction holes 523 are formed in the top part of each rib 521 and the slide contact face 522. The recording sheet PA is conveyed in the secondary scanning direction Y in a manner suctioned and stuck to the ribs 521 and the slide contact face 522 by a suction force E generated at each of the suction holes 523.

Figure 4:
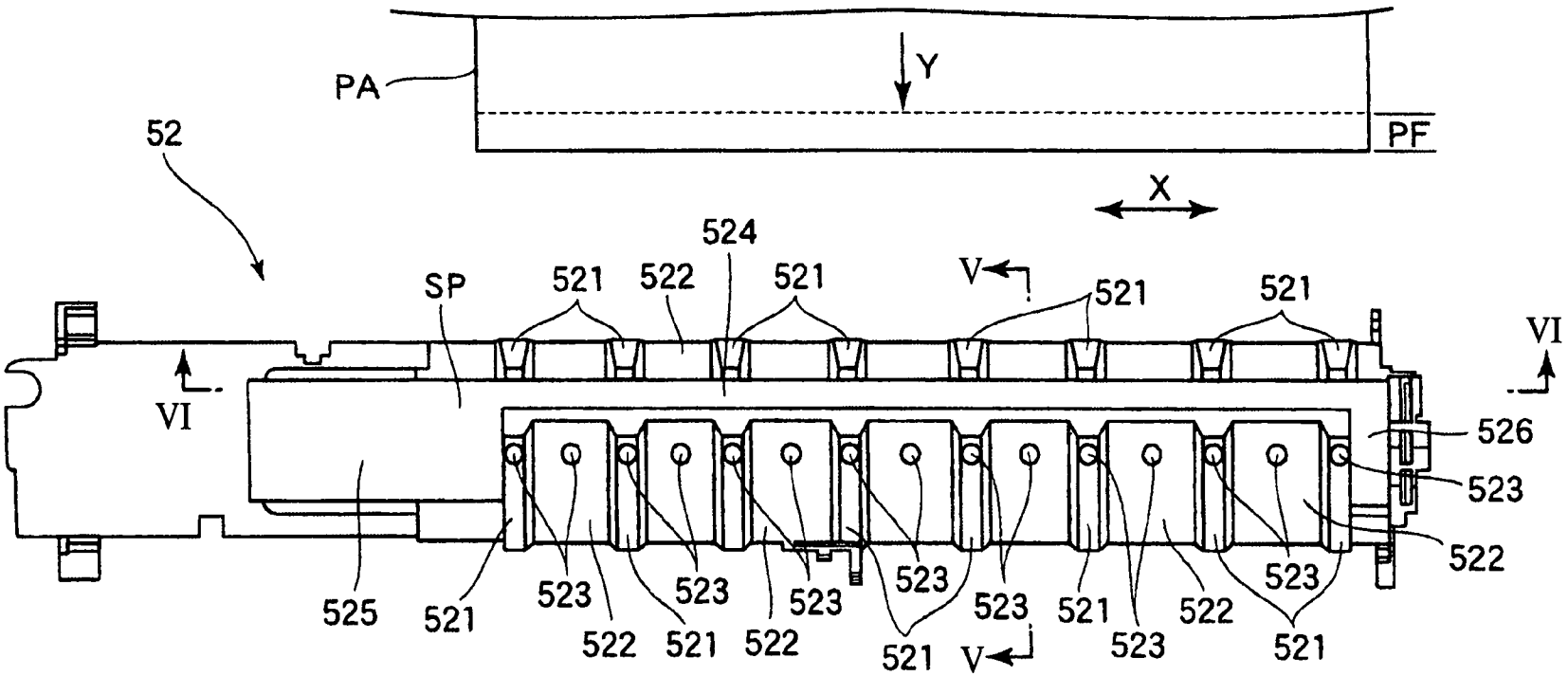
FIG. 4 is a plan view of a platen in the ink jet recording apparatus.

As shown in FIG. 4, the slide contact face 522 is provided with a transversal groove 524, a left side groove 525, and a right side groove 526 for performing recording without a blank space in the four sides of the recording sheet PA (referred to as marginless recording, hereinafter) while discarding the ink to the outside of the recording sheet PA. The transversal groove 524 is formed on the upstream side of the secondary scanning direction Y of the slide contact face 522 approximately in parallel to the primary scanning direction X in a manner crossing the ribs 521. Thus, when the ink is ejected without a blank space at the leading end and the trailing end of the recording sheet PA, the ink ejected to the outside of the recording sheet PA is discarded. The left side groove 525 and the right side groove 526 are formed respectively on both sides of the slide contact face 522. Thus, when the ink is ejected without a blank space at both side edges of the recording sheet PA, the ink ejected to the outside of the recording sheet PA is discarded respectively. The transversal groove 524, the left side groove 525, and the right side groove 526 are formed as a series of grooves having a C-shape in a plan view. An ink absorber SP is arranged inside of the grooves as shown in FIG. 5. The ink discarded in the marginless recording is absorbed and retained in this ink absorber SP.

When the recording sheet PA pinched by the conveyance driving roller 53 and the conveyance follower rollers 54 is conveyed to the platen 52 by the rotation of the conveyance driving roller 53, the recording sheet PA is conveyed in the direction indicated by symbol F (FIG. 5) in such a manner that the leading end portion PF has an approximately fixed angle θ relative to the slide contact face 522 of the platen 52 by virtue of the arrangement relationship of the conveyance follower rollers 54 relative to the conveyance driving roller 53 as shown in the figure. Thus, the recording sheet PA is conveyed in the secondary scanning direction Y in such a manner that the backside of the recording surface is pressed into a slide contact state against the slide contact face 522 and the ribs 521 of the platen 52. This pressing force on the recording sheet PA against the slide contact face 522 and ribs 521 reaches approximately the maximum in the vicinity of a portion where the leading end portion PF of the recording sheet PA abuts against the slide contact face 522 at the angle θ. Then, the force decreases with increasing distance from the conveyance driving roller 53 toward the downstream of the secondary scanning direction Y.

The means for generating the pressing force on the recording sheet PA against the slide contact face 522 and the ribs 521 of the platen 52 is not limited to the above-mentioned one that generates the force by virtue of the arrangement relationship of the conveyance follower rollers 54 relative to the conveyance driving roller 53. That is, any mode of the means is obviously included within the modes of the invention as long as a pressing force can be generated onto the recording sheet PA against the slide contact face 522 and the ribs 521 of the platen 52.

Figure 5:
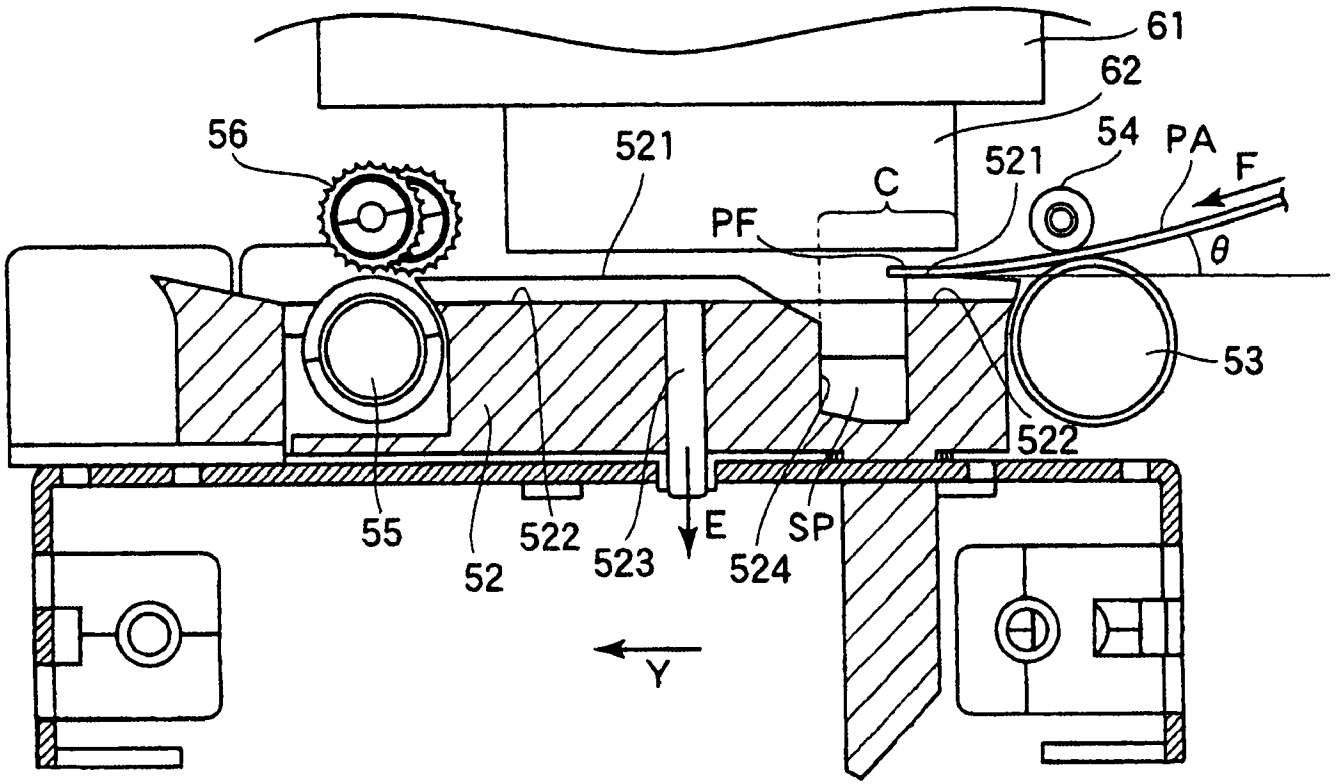
FIG. 5 is a view taken along line V-V in FIG. 4.
Figure 6:
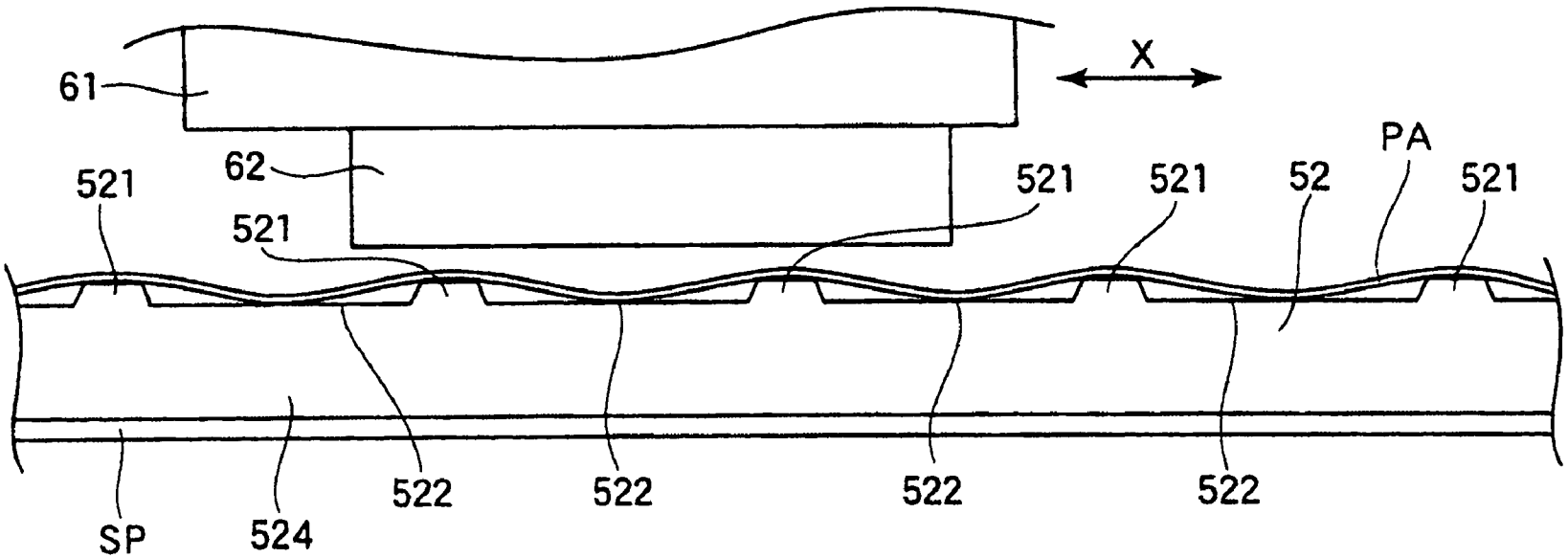
FIG. 6 is a view taken along line VI-VI in FIG. 4.

The leading end portion PF of the recording sheet PA at the recording start position is abutted against the slide contact face 522 at an angle θ as shown in FIG. 5. Thus, in the state that the recording sheet PA is at the recording start position, the pressing force in the leading end portion PF of the recording sheet PA against the slide contact face 522 and the ribs 521 reaches approximately the maximum. Then, at the recording start, the ink is intensively ejected (described later in detail) from a part of the head face of the recording head 62 corresponding to the leading end portion PF (portion indicated by symbol C of FIG. 5) onto the leading end portion PF of the recording sheet PA, so that recording onto the leading end portion PF is first completed, The pressing force and the intensive ink ejection allow the cockling in the leading end portion PF of the recording sheet PA to be formed reliably in a shape in accordance with the arrangement of the ribs 521 of the slide contact face 522 as shown in FIG. 6. This situation holds similarly in both of the marginless recording and the ordinary recording with blank spaces on the four sides.

As such, the ink is intensively ejected in the leading end portion PF of the recording sheet PA starting immediately after the recording start of the recording sheet PA, so that the recording onto the leading end portion PF is first completed at an early stage after the recording start (described later in detail). That is, in the leading end portion PF of the recording sheet PA, the corrugating deformation by cockling becomes saturated so that the corrugating deformation shape becomes stable at an early stage. Accordingly, in the initial stage of recording onto the recording sheet PA, cockling of a fixed pitch (cockling having a shape in accordance with the arrangement of the ribs 521) can be accomplished at an early step in the leading end portion PF of the recording sheet PA. Since the cockling of a fixed pitch is accomplished in the leading end portion PF of the recording sheet PA at an early step of the recording start, cockling formed by the subsequent ink ejection is formed approximately at the same pitch as that of the cockling formed first.

That is, the cockling in the leading end portion PF of the recording sheet PA that determines the pitch of the cockling formed over the entire surface of the recording sheet PA is accomplished at an early step of the initial stage of recording. Thus, cockling of a fixed pitch in accordance with the shape and arrangement of a plurality of ribs 521 formed in the slide contact face 522 of the platen 52 can be more reliably formed over the entire surface of the recording sheet PA. This reduces concern that the cockling pitch may become unstable so that the recording sheet PA may be lifted and thereby cause head rubbing.

Further, the recording sheet PA is conveyed in the secondary scanning direction Y in a state suctioned and stuck to the ribs 521 and the slide contact face 522 by the suction force E generated at each of the suction holes 523. This reduces more reliably the concern that the recording sheet PA may be lifted from the slide contact face 522 of the platen 52.

Further, since a plurality of the ejection follower rollers 56 are arranged at positions corresponding to the ribs 521 (FIG. 1), ridge portions of corrugating deformation of the cockling are pinched by the ejection driving roller 55 and the ejection follower rollers 56. Further, ejection follower rollers may further be arranged also in the approximate middle portions of the ribs 521. This helps the valley formation of the cockling, and restricts the lifting of the valley portions. This further reduces the concern that the recording sheet PA suffering the corrugating deformation by cockling may be lifted.

Further, the transversal groove 524 into which the ink ejected to the outside of the recording sheet PA is discarded when the ink is ejected without a blank space at the leading edge (leading end portion PF) and the trailing edge of the recording sheet PA is arranged at a position that permits the recording without a blank space at the leading end portion PF of the recording sheet PA while discarding the ink to the outside of the leading end portion PF of the recording sheet PA when the recording sheet PA is located at the above-mentioned recording start position. Thus, also in the marginless recording, cockling of a fixed pitch is accomplished in the leading end portion PF of the recording sheet PA at an early step of the recording start.

Figure 7:
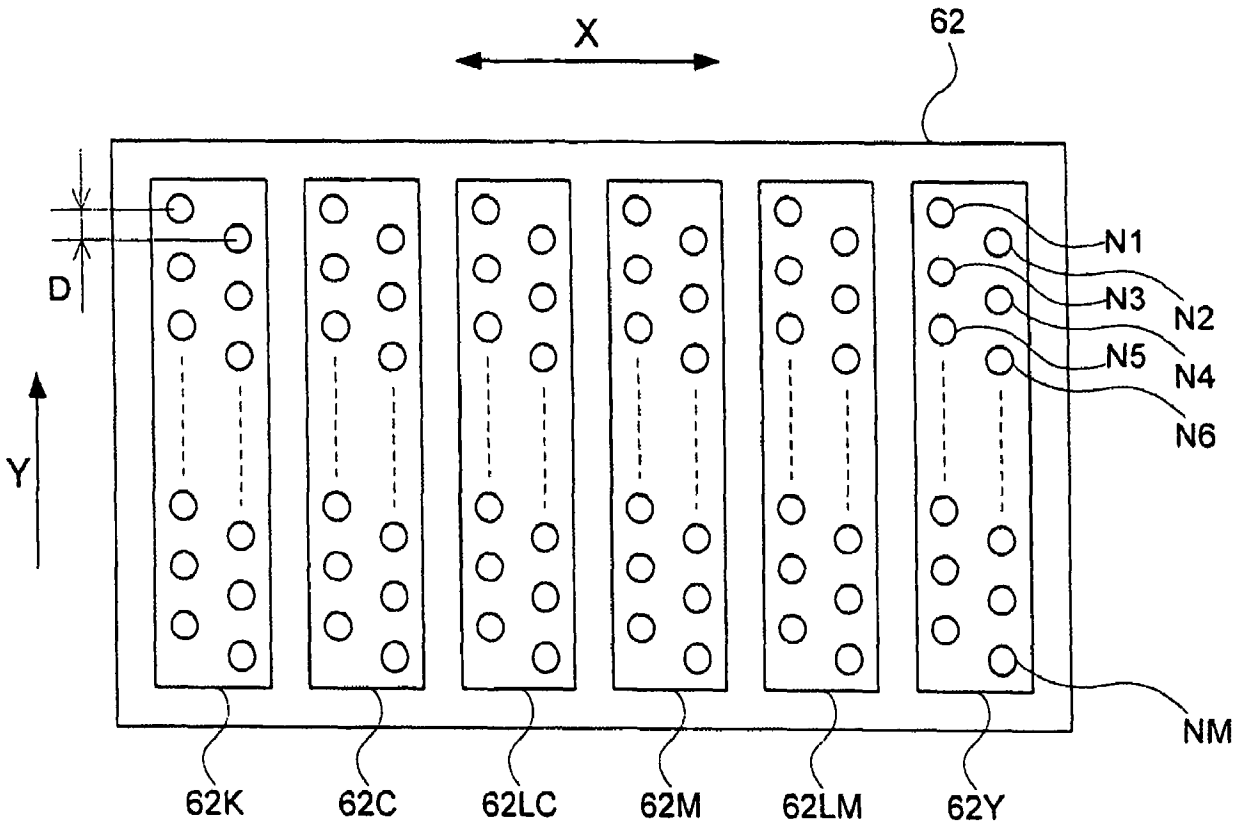
FIG. 7 is a schematic plan view of a head face of a recording head.

As shown in FIG. 7, in the head face of the recording head 62, nozzle arrays 62K, 62C, 62LC, 62M, 62LM, 62Y are arranged in the primary scanning direction X approximately in parallel to each other. In each of the nozzle arrays, nozzles N1-NM are arrayed in the secondary scanning direction Y at a fixed pitch D. Black ink is ejected from the nozzles N1-NM of the nozzle array 62K. Cyan ink is ejected from the nozzles N1-NM of the nozzle array 62C. Light cyan ink is ejected from the nozzles N1-NM of the nozzle array 62LC. Magenta ink is ejected from the nozzles N1-NM of the nozzle array 62M. Light magenta ink is ejected from the nozzles N1-NM of the nozzle array 62LM. Yellow ink is ejected from the nozzles N1-NM of the nozzle array 62Y. Thus, dots of each color can be formed. When dots of different colors are formed and overlapped at the same dot formation position, recording is realized in a wide range of a variety of color representations.

The above-mentioned part of the head face of the recording head 62 corresponding to the leading end portion PF of the recording sheet PA (portion indicated by symbol C of FIG. 5) at the recording start position includes the nozzles NM arranged on the most upstream side of the secondary scanning direction Y of the head face of the recording head 62. When the recording onto the leading end portion PF of the recording sheet PA is completed using a plurality of the nozzles including the nozzles NM on the most upstream side of the secondary scanning direction Y, cockling of a fixed pitch can be formed at an early step in the leading end portion PF of the recording sheet PA on the most upstream side of the secondary scanning direction Y. Thus, the cockling of a fixed pitch can stably be formed in the leading end portion PF of the recording sheet PA at an earlier stage of recording start.

Next, an interlace recording method performed in the above configuration will be described below with reference to FIGS. 8 and 9.

Figure 8:
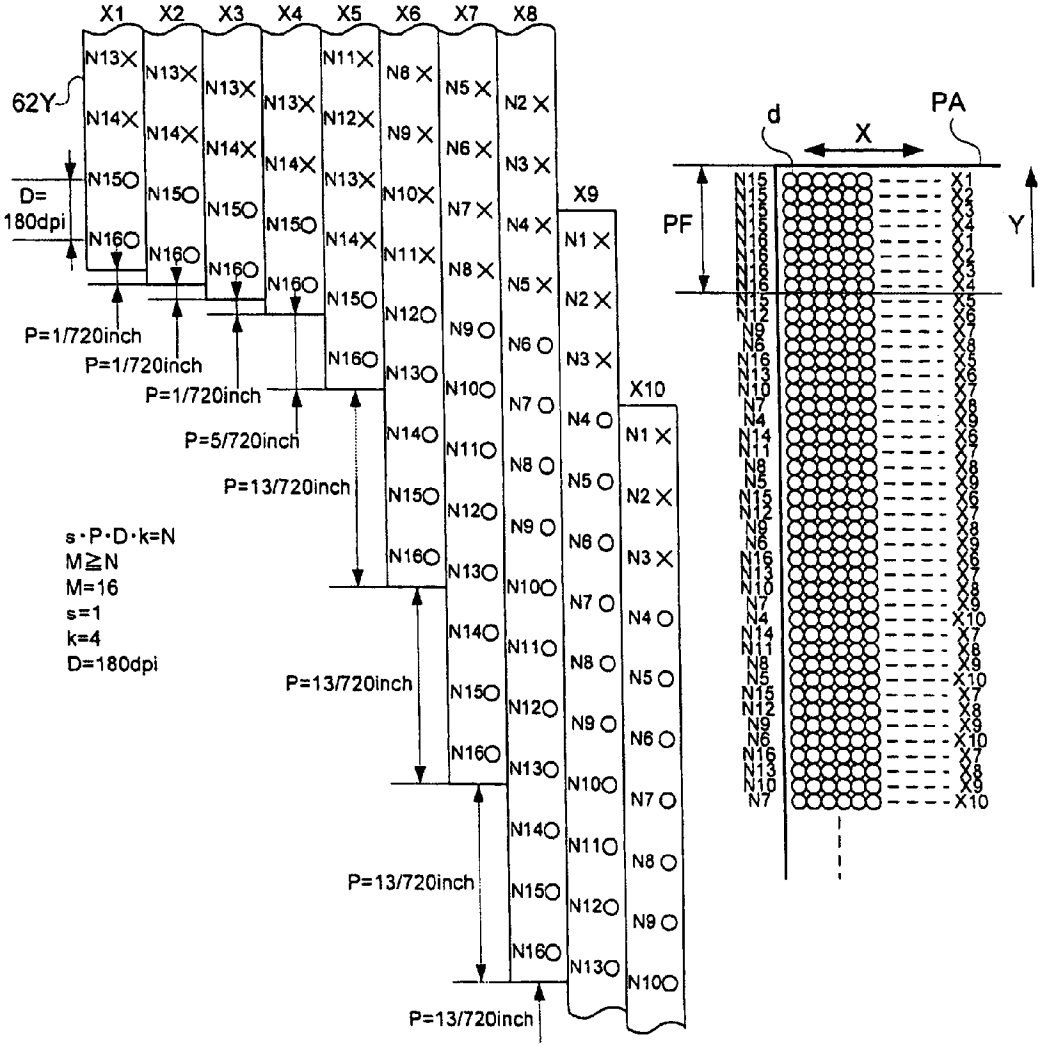
FIG. 8 is a diagram showing a first example of an interlace recording performed in the ink jet recording apparatus.

FIG. 8 shows a first example. The recording controller 100 performs recording in such a manner that: the total number of the nozzles of each nozzle array is denoted by the total number of nozzles M; the number of nozzles used among the total number of nozzles M is denoted by the number of usage nozzles N; a predetermined conveyance rate of the recording sheet PA is denoted by a conveyance rate P; the number of the nozzles which are present per unit distance in each nozzle array is denoted by a nozzle distribution density (pitch) D; the value of a distance between centers of the adjacent nozzles which is expressed by a multiple of a distance between centers of formed dots in the secondary scanning direction Y is denoted by an interpolation coefficient k; and the number of times of primary scanning operation necessary for forming a line where dots continue in the primary scanning direction X is denoted by the number of times of scan s; while the number of times of scan s is set to be an integer greater than or equal to 1 and smaller than N, and while the interpolation coefficient k and N/s are set to be integers which are relatively prime and greater than or equal to 2 and smaller than N, and at the same time, values are selected such that a relational expression $P=N/(s \cdot D \cdot k)$ is satisfied.

The following description is given for the nozzle array 62Y as an example. Further, the total number of nozzles M of each nozzle array is M=16 in the figure for simplicity of description. However, the total number of nozzles M arranged in an actual recording head 62 is 10 times or more of this exemplary value. Each white circle mark in the nozzle array 62Y indicates a usage nozzle, while each mark "x" indicates a non-usage nozzle. In the raster formed in the recording sheet PA by dots d (dot train in the primary scanning direction X), the nozzle number (N1-N16) of a nozzle having formed the raster is indicated on the left-hand side, while a primary scanning operation (X1-) having formed the raster is indicated on the right-hand side. The nozzle distribution density of the recording head 62 is D=180 dpi. In this example, interlace recording is performed with the setting of the number of times of scan s=1 and the interpolation coefficient k=4.

From the first primary scanning operation X1 to the fourth primary scanning operation X4 after the recording start, recording is performed using only the nozzle N16 and the nozzle N15 on the most upstream side of the secondary scanning direction Y. The conveyance rate P for the recording sheet PA in this duration is set to be 1/720 inches which is the minimum feeding rate. During the four primary scanning operations (X1-X4) after the recording start, the ink is ejected intensively only from the nozzle N15 and the nozzle N16 onto the leading end portion PF of the recording sheet PA with the minimum feeding rate, so that the recording onto the leading end portion PF is completed. As such, the ink is intensively ejected onto the leading end portion PF of the recording sheet PA starting immediately after the recording start of the recording sheet PA by using the nozzle N16 on the most upstream side of the secondary scanning direction Y, so that the recording onto the leading end portion PF is first completed at an early step after the recording start. Accordingly, in the initial stage of recording onto the recording sheet PA, cockling of a fixed pitch (cockling having a shape in accordance with the arrangement of the ribs 521) can be accomplished at an early step in the leading end portion PF of the recording sheet PA. That is, the cockling in the leading end portion PF of the recording sheet PA that determines the pitch of the cockling formed over the entire surface of the recording sheet PA is accomplished at an early step of the initial stage of recording.

Then, after the fourth primary scanning operation X4, conveyance is performed at a conveyance rate P=5/720 inches. After that, in the fifth primary scanning operation X5 and in the subsequent operations, interlace recording by fixed feeding rate is performed at a conveyance rate P=13/720 inches. In order to avoid overlap in the raster, the number of usage nozzles N is gradually increased into N=5 (nozzles N12-N16) in the sixth primary scanning operation X6, N=8 (nozzles N9-N16) in the seventh primary scanning operation X7, and N=11 (nozzles N6-N16) in the eighth primary scanning operation X8. Then, in the ninth primary scanning operation X9 and in the subsequent operations, the recording is performed with N=13 (nozzles N4-N16) that satisfies the relational expression $P=N/(s \cdot D \cdot k)$. In the fifth primary scanning operation X5 and in the subsequent operations, by virtue of the cockling formed in the leading end portion PF, cockling of a fixed pitch in accordance with the shape and arrangement of a plurality of the ribs 521 formed in the slide contact face 522 of the platen 52 is formed over the entire surface of the recording sheet PA.

This reduces concern that the cockling pitch may become unstable so that the recording sheet PA may be lifted and thereby cause head rubbing.

Figure 9:
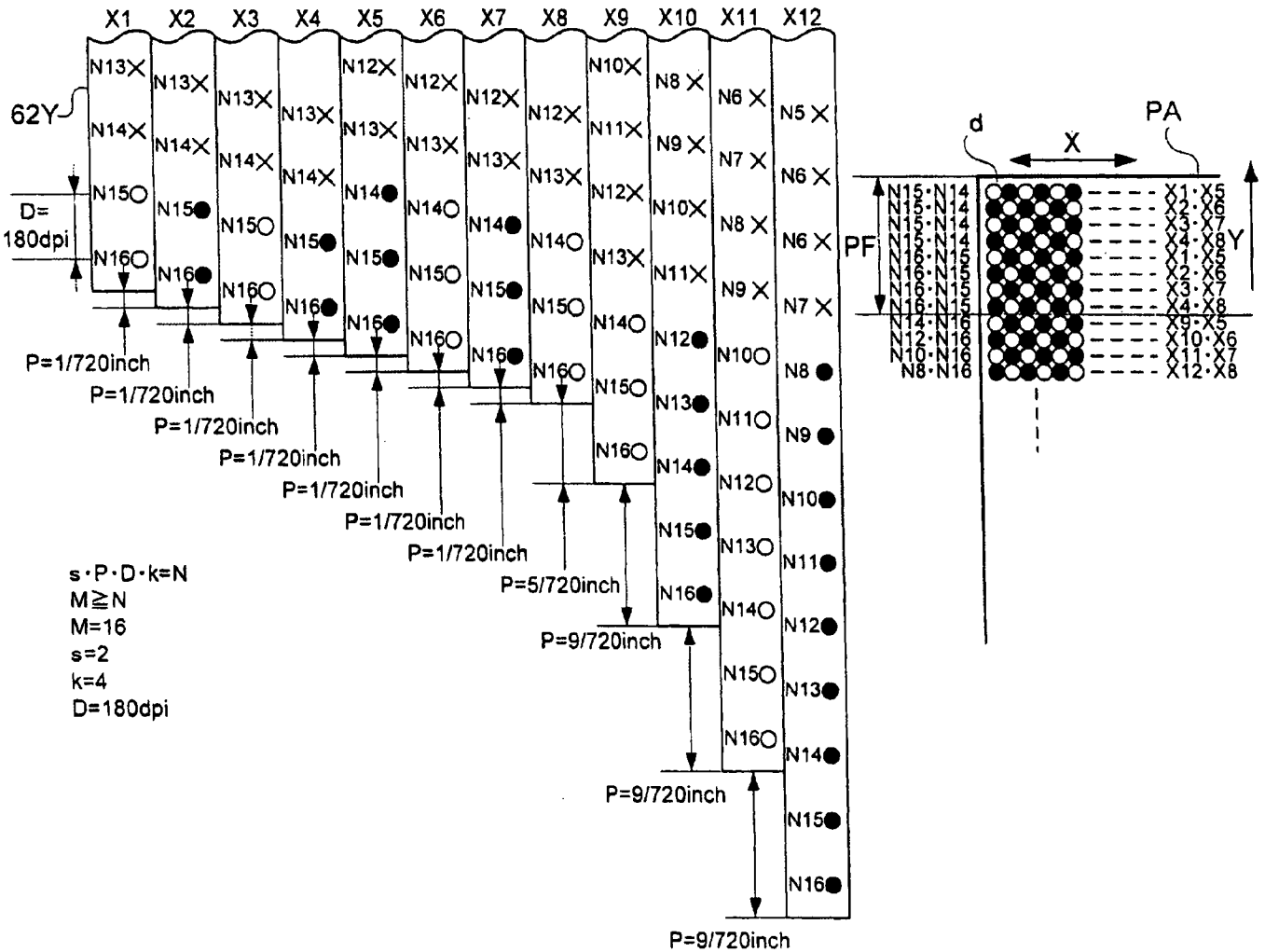
FIG. 9 is a diagram showing a second example of the interlace recording.

FIG. 9 shows a second example of the interlace recording method. Each of the white circle marks and black circle marks in the nozzle array 62Y indicates a usage nozzle, while each mark "x" indicates a non-usage nozzle. Then, interlace recording of full overlap is performed with the setting of the number of times of scan s=2 and the interpolation coefficient k=4. The other setting conditions and the like are the same as in the first example.

From the first primary scanning operation X1 to the eighth primary scanning operation X8 after the recording start, recording is performed using only the nozzle N16, the nozzle N15, and the nozzle N14 on the most upstream side of the secondary scanning direction Y. The conveyance rate P for the recording sheet PA in this duration is set to be 1/720 inches which is the minimum feeding rate. During the eight primary scanning operations (X1-X8) after the recording start, ink is ejected intensively only from the nozzle N14, the nozzle N15, and the nozzle N16 onto the leading end portion PF of the recording sheet PA, so that the recording onto the leading end portion PF is completed. Similarly to the first example, the ink is intensively ejected onto the leading end portion PF of the recording sheet PA starting immediately after the recording start of the recording sheet PA, so that the recording onto the leading end portion PF is first completed at an early step after the recording start. Accordingly, in the initial stage of recording onto the recording sheet PA, cockling of a fixed pitch (cockling having a shape in accordance with the arrangement of the ribs 521) can be accomplished at an early step in the leading end portion PF of the recording sheet PA.

Then, after the eighth primary scanning operation X8, conveyance is performed at a conveyance rate P=5/720 inches. After that, in the ninth primary scanning operation X9 and in the subsequent operations, interlace recording of full overlap by a fixed feeding rate is performed at a conveyance rate P=9/720 inches. In order to avoid overlap in the raster, the number of usage nozzles N is gradually increased into N=5 (nozzles N12-N16) in the tenth primary scanning operation X10 and N=7 (nobles N10-N16) in the eleventh primary scanning operation X11. In the twelfth primary scanning operation X12 and in the subsequent operations, recording is performed with N=9 (nozzles N8-N16) that satisfies the relational expression P=N/(s·D·k). In the ninth primary scanning operation X9 and in the subsequent operations, by virtue of the cockling formed in the leading end portion PF, cockling of a fixed pitch in accordance with the shape and arrangement of a plurality of ribs 521 formed in the slide contact face 522 of the platen 52 is formed over the entire surface of the recording sheet PA.

As such, also in the interlace recording of full overlap, the concern is reduced that the cockling pitch may become unstable so that the recording sheet PA may be lifted and thereby cause head rubbing.

The invention is not limited to the above-mentioned examples. That is, various modifications are possible within the scope of the invention set forth in the claims, while these modifications are obviously included within the scope of the invention.

Here, the term "liquid ejecting apparatus" is used for referring not only to a recording apparatus, such as a printer, a copier, and a facsimile machine, having an ink jet recording head for ejecting ink from the recording head so as to perform recording on a recording medium but also to an apparatus that causes liquid to adhere onto a medium, corresponding to the recording medium in the above-described recording apparatus, by ejecting liquid selected depending on the use of the apparatus in place of ink onto the medium from a liquid ejecting head corresponding to the above-described ink jet recording head.

As the liquid ejecting head, the following heads can be considered other than the above-described recording head: a color-material ejecting head used for manufacturing a color filter for a liquid crystal display or the like, an electrode-material (conductive paste) ejecting head used for forming an electrode in an organic electroluminescent (EL) display or a field-emission display (FED), a bioorganic compound ejecting head used for manufacturing a biochip, and a sample spraying head as a precision pipette.

What is claimed is:

1. A liquid ejecting apparatus, comprising:

a liquid ejecting head, having a head face on which nozzles adapted to eject liquid toward a first face of a target medium, to perform a recording on the target medium, are arranged, the liquid ejecting head adapted to move in a first direction;

a conveyance guide member, adapted to support a second face of the target medium so that a distance between the head face and the first face of the target medium is made to be a prescribed value, the conveyance guide member including a plurality of ribs arrayed in the first direction and extending in a second direction perpendicular to the first direction; and a medium conveyer, adapted to convey the target medium in the second direction while causing the second face of the target medium to be abutted against the conveyance guide member, wherein, the liquid ejecting apparatus further comprising a controller operable to cause the liquid ejecting head to perform the recording on a leading end portion of the target medium by using only a first set of the nozzles when the leading end portion is abutted against the ribs and to cause the liquid ejecting head to perform the recording on a portion of the target medium, other than the leading end portion by using a second set of the nozzles after the recording on the leading end portion is completed, wherein the first set of the nozzles is located at an upstream end position in the second direction and located over the ribs, and wherein the number of nozzles in the second set of the nozzles is greater than the number of nozzles in the first set of the nozzles.

* * * * *